US006095205A

United States Patent [19]

Nagasawa

[11] Patent Number: 6,095,205

[45] Date of Patent: Aug. 1, 2000

[54] AUTOMATIC VENDING MACHINE IN WHICH A CUP HOLDER CAN BE WASHED AT AN INNER WASHING POSITION

[75] Inventor: Takashi Nagasawa, Isesaki, Japan

[73] Assignee: Sanden Corporation, Japan

[21] Appl. No.: 09/212,437

[22] Filed: Dec. 16, 1998

[30] Foreign Application Priority Data

Dec. 22, 1997 [JP] Japan ..... 9-351850

[51] Int. Cl.[7] ..... B65B 1/04

[52] U.S. Cl. ..... 141/89; 141/85; 141/91

[58] Field of Search ..... 141/85, 86, 88, 141/89, 91; 134/104.1; 222/148

[56] References Cited

U.S. PATENT DOCUMENTS 3,615,673 10/1971 Black ..... 99/79

4,480,764 11/1984 Takagi et al. ..... 221/11

5,941,290 8/1999 Vaughn, Jr. ..... 141/90

FOREIGN PATENT DOCUMENTS 58-142496 8/1983 Japan .

*Primary Examiner*—Steven O. Douglas
*Assistant Examiner*—Timothy L. Maust
*Attorney, Agent, or Firm*—Banner & Witcoff, Ltd.

[57] ABSTRACT

In an automatic vending machine for vending a beverage poured into a cup, a washing position is determined for a wash of a cup holder (3) which is for holding the cup. A driving unit (57,63) can move the cup holder under control of a control unit which is for controlling operation of the automatic vending machine. Before the cup holder is washed, the driving unit makes the cup holder be placed at the washing position that may be determined by a washing nozzle (80) for discharging washing water.

8 Claims, 5 Drawing Sheets

AUTOMATIC VENDING MACHINE IN WHICH A CUP HOLDER CAN BE WASHED AT AN INNER WASHING POSITION

BACKGROUND OF THE INVENTION

This invention relates to an automatic vending machine for vending a beverage poured into a cup.

A conventional automatic vending machine of the type comprises a cup dispenser, a cup holder for holding a cup supplied from the cup dispenser, and a cup holder driving device for horizontally moving the cup holder. Generally, when the automatic vending machine is in a standby state, the cup holder is located at a cup outlet position adjacent to a beverage outlet port formed in a front door of the automatic vending machine to take out the beverage. When a user puts a coin into a coin slot formed in the front door of the automatic vending machine and pushes a select button attached to the front door to select a desired beverage, the automatic vending machine is put into operation, i.e., starts a vending operation. At first, the cup is supplied from the cup dispenser and held by the cup holder. Then, the cup holder is horizontally moved by the cup holder driving device to a pouring position faced to a discharge nozzle of the desired beverage. The desired beverage is discharged from the discharge nozzle to be poured into the cup held by the cup holder. Thereafter, the cup holder is horizontally moved by the cup holder driving device from the pouring position to the cup outlet position. Through the beverage outlet port, the user takes out the cup filled with the desired beverage.

During the vending operation, the cup holder is exposed to splash of the beverage discharged from the discharge nozzle or after-dripping from the discharge nozzle. It is therefore necessary to periodically wash the cup holder. For this purpose, the front door of the automatic vending machine in the standby state is opened to wash the cup holder by washing water.

At a moment when the front door of the automatic vending machine in the standby state is opened in order to wash the cup holder, the cup holder is located at the cup outlet position adjacent to the beverage outlet port formed in the front door of the automatic vending machine. Therefore, the washing water inevitably splashes out of the automatic vending machine to soil a floor surface where the automatic vending machine is installed.

SUMMARY OF THE INVENTION

It is therefore an object of the present invention to provide an automatic vending machine for vending a beverage poured in a cup, which is capable of preventing washing water to wash a cup holder from splashing out of the automatic vending machine to soil a floor surface where the automatic vending machine is installed.

Other objects of the present invention will become clear as the description proceeds.

An automatic vending machine to which the present invention is applicable is for vending a beverage poured into a cup. The automatic vending machine comprises control means for controlling operation of said automatic vending machine, a cup holder for holding said cup, a washing position determined for a wash of said cup holder, and a driving unit connected to said cup holder and said control means for moving said cup holder under control of said control means, said driving unit making said cup holder be placed at said washing position before said cup holder is washed.

DESCRIPTION OF THE PREFERRED EMBODIMENT

Referring to FIGS. 1 through 5, description will be made about a one-cup beverage automatic vending machine according to an embodiment of this invention. For brevity of description, the one-cup beverage automatic vending machine will simply be referred to as the automatic vending machine hereinafter. In FIGS. 2 through 5, forward, backward, leftward, rightward, upward, and downward directions are depicted by arrows I, II, III, IV, V, and VI, respectively. If necessary, the leftward and the rightward directions are collectively referred to as a first horizontal direction parallel to a front surface of the automatic vending machine while the forward and the backward directions are collectively referred to as a second horizontal direction perpendicular to the first horizontal direction. Likewise, the upward and the downward directions may be collectively referred to as a vertical direction.

A one-cup beverage automatic vending machine A serves to provide a user with a desired beverage poured into a cup. The desired beverage is selected by the user from various kinds of beverages including a syrup beverage prepared by diluting a condensed syrup with ice-mixed cold water, a carbonic syrup beverage prepared by diluting a condensed syrup with ice-mixed carbonic water, a regular coffee extracted from coffee powder obtained by milling coffee beans, an instant beverage prepared by dissolving instant coffee powder, instant cocoa powder, or instant tea powder in hot water, and a fruit juice beverage or a lactic acid beverage prepared by diluting a raw condensation with water.

Figure 1:
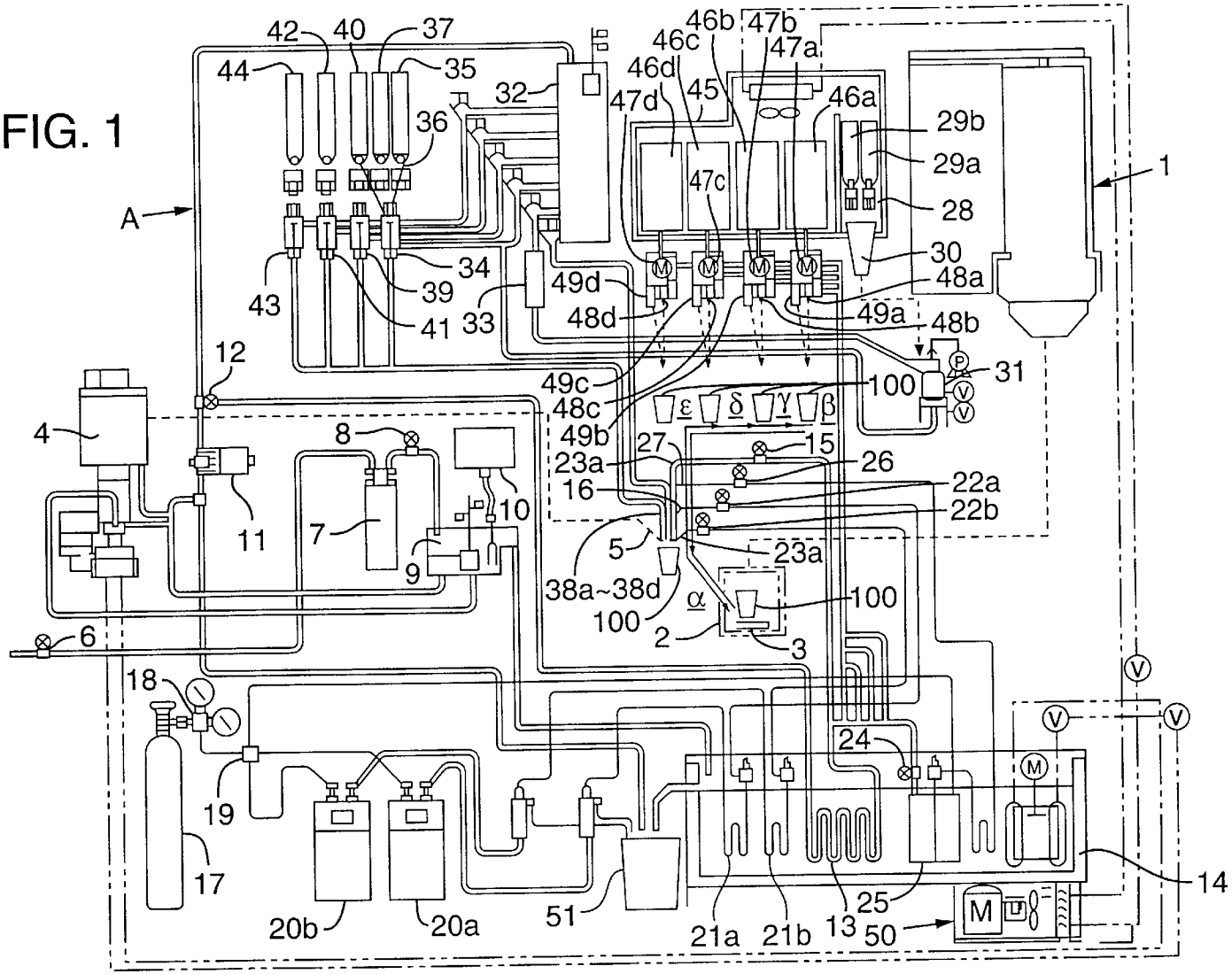
FIG. 1 is a system diagram of a one-cup beverage automatic vending machine according to an embodiment of this invention.

Referring to FIG. 1, a vending operation of the syrup beverage will be described. As illustrated in the figure, a cup 100 is supplied from a cup dispenser 1 to a cup holder 3 located at a cup outlet position 2 immediately behind a beverage outlet port A3 which will later be described. The cup holder 3 with the cup 100 mounted thereon is horizontally moved from the cup outlet position 2 to a first position $\alpha$.

The cup 100 mounted on the cup holder 3 located at the first position $\alpha$ is supplied with ice cubes produced by an ice maker 4 and delivered through a chute 5.

On the other hand, tap water from a water supply pipe (not shown) is introduced into the automatic vending machine A through an electromagnetic valve 6. The tap water is made to pass through a filter 7 to remove iron rust and other contaminants mixed therein. Then, the tap water flows through an electromagnetic valve 8 into a sterilization tank 9 to be sterilized by a chlorine gas produced by a chlorine generator 10 so that sterilized tap water is obtained. On one hand, the sterilized tap water is delivered from the sterilization tank 9 through a pump 11 and an electromagnetic valve 12 to a cold water coil 13 as drinking water. On the other hand, the sterilized tap water is supplied from the sterilization tank 9 to a cooling water tank 14 as cooling water. The cold water coil 13 is immersed in the cooling water within the cooling water tank 14. The cooling water in the cooling water tank 14 is cooled down to a temperature around 0° C. by a refrigerant supplied from a cooling unit for the ice maker 4. The drinking water flowing through the cold water coil 13 is cooled by the cooling water to become cold drinking water. After passing through the cold water coil 13, the cold drinking water passes through an electromagnetic valve 15 and is discharged from a cold drinking water discharge nozzle 16 obliquely downward to be poured into the cup 100 mounted on the cup holder 3 at the first position α.

When the user selects a first syrup beverage, carbonic acid gas is discharged from a gas cylinder 17 through a regulator 18 to be supplied through a switching valve 19 into a syrup tank 20*a*. Under a gas pressure of the carbonic acid gas supplied to the syrup tank 20*a*, a first condensed syrup in the syrup tank 20*a* is forced to flow out from the syrup tank 20*a* to be delivered to a syrup coil 20*a*. The syrup coil 20*a* is immersed in the cooling water within the cooling water tank 14. The first condensed syrup flowing through the syrup coil 20*a* is cooled by the cooling water. After passing through the syrup coil 20*a*, the first condensed syrup passes through an electromagnetic valve 22*a* and is discharged from a condensed syrup discharge nozzle 23*a* obliquely downward to be poured into the cup 100 mounted on the cup holder 3 at the first position α.

When the user selects a second syrup beverage, the carbonic acid gas is discharged from the gas cylinder 17 through the regulator 18 to be supplied through the switching valve 19 into a syrup tank 20*b*. Under a gas pressure of the carbonic acid gas supplied to the syrup tank 20*b*, a second condensed syrup in the syrup tank 20*b* is forced to flow out from the syrup tank 20*b* to be delivered to a syrup coil 21*b*. The syrup coil 21*b* is immersed in the cooling water within the cooling water tank 14. The second condensed syrup flowing through the syrup coil 21*b* is cooled by the cooling water. After passing through the syrup coil 21*b*, the second condensed syrup passes through an electromagnetic valve 22*b* and is discharged from a condensed syrup discharge nozzle 23*b* obliquely downward to be poured into the cup 100 mounted on the cup holder 3 at the first position α.

The cold drinking water and the first or the second condensed syrup are simultaneously supplied to the cup 100.

In the above-mentioned manner, the supply of the first or the second syrup beverage into the cup 100 mounted on the cup holder 3 at the first position α is completed. Then, the cup holder 3 is moved to the cup outlet position 2. The user takes out the cup 100 filled with the first or the second syrup beverage.

Next, description will be made about a vending operation of the carbonic syrup beverage. As illustrated in FIG. 1, the cold drinking water passing through the cold water coil 13 flows through an electromagnetic valve 24 into a water/gas mixing tank 25. On the other hand, the carbonic acid gas discharged from the gas cylinder 17 through the regulator 18 is supplied through the switching valve 19 to the water/gas mixing tank 25. Within the water/gas mixing tank 25, the carbonic acid gas is mixed into the cold drinking water to produce cold carbonic drinking water. Under a gas pressure of the carbonic acid gas, the cold carbonic drinking water is forced to flow out from the water/gas mixing tank 25. The cold carbonic drinking water passes through an electromagnetic valve 26 and is discharged from a cold carbonic drinking water discharge nozzle 27 obliquely downward to be poured into the cup 100 mounted on the cup holder 3 at the first position α. In the manner similar to the vending operation of the syrup beverage, the ice cubes and the condensed syrup are also supplied to the cup 100 mounted on the cup holder 3 at the first position α.

In the above-mentioned manner, the supply of the carbonic syrup beverage into the cup 100 mounted on the cup holder 3 at the first position α is completed. Then, the cup holder 3 is moved to the cup outlet position 2. The user takes out the cup 100 filled with the carbonic syrup beverage.

Description will be made about a vending operation of the regular coffee. As illustrated in FIG. 1, a refrigerator 28 has coffee beans powder storage tanks 29*a* and 29*b* which store first coffee beans powder and second coffee beans powder, respectively. When the user selects a first regular coffee, the first coffee beans powder is supplied from the coffee beans powder storage tank 29*a* through a chute 30 to a coffee extraction unit 31. When the user selects a second regular coffee, the second coffee beans powder is supplied from the coffee beans powder storage tank 29*b* through the chute 30 into the coffee extraction unit 31.

On the other hand, the sterilized tap water is delivered from the sterilization tank 9 through the pump 11 to a hot water tank 32 as drinking water. The drinking water is heated by a heater (not shown) arranged in the hot water tank 32 to become hot drinking water. The hot drinking water in the hot water tank 32 is reheated through a reheating unit 33 and then supplied to the coffee extraction unit 31.

Within the coffee extraction unit 31, the coffee beans powder and the hot drinking water are mixed and a liquid coffee extract is obtained. The liquid coffee extract is sent to a mixing unit 34. Coffee grounds are discarded into a waste box (not shown). Sugar powder is supplied from a sugar storage tank 35 through a chute 36 into the mixing unit 34. Cream powder is supplied from a cream storage tank 37 through the chute 36 into the mixing unit 34. In the mixing unit 34, the liquid coffee extract, the sugar powder, and the cream powder are mixed to produce the regular coffee with sugar and cream. The regular coffee flows out from the mixing unit 34 and is discharged from a regular coffee discharge nozzle 38*a* obliquely downward to be poured into the cup 100 mounted on the cup holder 3 at the first position α.

The hot drinking water is supplied from the hot water tank 32 into the mixing unit 34 to wash the mixing unit 34. After washing, the hot drinking water is discharged from the regular coffee discharge nozzle 38*a* obliquely downward to be poured into the cup 100 mounted on the cup holder 3 at the first position α. The regular coffee discharge nozzle 38*a* is washed by the hot drinking water.

In the above-mentioned manner, the supply of the regular coffee into the cup 100 mounted on the cup holder 3 at the first position α is completed. Then, the cup holder 3 is moved to the cup outlet position 2. The user takes out the cup 100 filled with the regular coffee.

Description will be made about a vending operation of the instant beverage. When the user selects the instant coffee, the hot drinking water in the hot water tank 32 is delivered to a mixing unit 39. On the other hand, instant coffee powder with sugar contained therein is supplied from an instant coffee powder storage tank 40 through a chute (not shown)

to the mixing unit 39. In the mixing unit 39, the hot drinking water and the instant coffee powder with sugar are mixed to produce a liquid instant coffee. The liquid instant coffee flows out from the mixing unit 39 and is discharged from an instant coffee discharge nozzle 38*b* obliquely downward to be poured into the cup 100 mounted on the cup holder 3 at the first position α. The hot drinking water is supplied from the hot water tank 32 to the mixing unit 39 to wash the mixing unit 39. After washing, the hot drinking water is discharged from the instant coffee discharge nozzle 38*b* obliquely downward to be poured into the cup 100 mounted on the cup holder 3 at the first position α. The instant coffee discharge nozzle 38*b* is washed by the hot drinking water.

When the user selects the instant cocoa, the hot drinking water in the hot water tank 32 is delivered to a mixing unit 41. On the other hand, instant cocoa powder with sugar contained therein is supplied from an instant cocoa powder storage tank 42 through a chute (not shown) to the mixing unit 41. In the mixing unit 41, the hot drinking water and the instant cocoa powder with sugar are mixed to produce a liquid instant cocoa. The liquid instant cocoa flows out from the mixing unit 41 and is discharged from an instant cocoa discharge nozzle 38*c* obliquely downward to be poured into the cup 100 mounted on the cup holder 3 at the first position α. The hot drinking water is supplied from the hot water tank 32 to the mixing unit 41 to wash the mixing unit 41. After washing, the hot drinking water is discharged from the instant cocoa discharge nozzle 38*c* obliquely downward to be poured into the cup 100 mounted on the cup holder 3 at the first position α. The instant cocoa discharge nozzle 38*c* is washed by the hot drinking water.

When the user selects the instant tea, the hot drinking water in the hot water tank 32 is delivered to a mixing unit 43. On the other hand, instant tea powder with sugar contained therein is supplied from an instant tea powder storage tank 44 through a chute (not shown) to the mixing unit 43. In the mixing unit 43, the hot drinking water and the instant tea powder with sugar are mixed to produce a liquid instant tea. The liquid instant tea flows out from the mixing unit 43 and is discharged from an instant tea discharge nozzle 38*d* obliquely downward to be poured into the cup 100 mounted on the cup holder 3 at the first position α. The hot drinking water is supplied from the hot water tank 32 to the mixing unit 43 to wash the mixing unit 43. After washing, the hot drinking water is discharged from the instant tea discharge nozzle 38*d* obliquely downward to be poured into the cup 100 mounted on the cup holder 3 at the first position α. The instant tea discharge nozzle 38*d* is washed by the hot drinking water.

In the above-mentioned manner, the supply of the instant coffee, the instant cocoa, or the instant tea into the cup 100 mounted on the cup holder 3 at the first position α is completed. Then, the cup holder 3 is moved to the cup outlet position 2. The user takes out the cup 100 filled with the instant coffee, the instant cocoa, or the instant tea.

Description will be made about a vending operation of the fruit juice beverage or the lactic acid beverage.

When the user selects a first beverage, the cup 100 is supplied from the cup dispenser 1 to the cup holder 3 at the cup outlet position 2, as illustrated in FIG. 1. The cup holder 3 with the cup 100 mounted thereon moves from the cup outlet position 2 to a second position β. A first raw condensation in a raw condensation tank 46*a* cooled and stored in a refrigerator 45 is sent through a tubing pump 47*a* and discharged from a raw condensation discharge nozzle 48*a* generally vertically downward to be poured into the cup 100 mounted on the cup holder 3 at the second position β. The cold drinking water passing through the cold water coil 13 is discharged from a cold drinking water discharge nozzle 49*a* generally vertically downward to be poured into the cup 100 mounted on the cup holder 3 at the second position β.

When the user selects a second beverage, the cup 100 is supplied from the cup dispenser 1 to the cup holder 3 at the cup outlet position 2, as illustrated in FIG. 1. The cup holder 3 with the cup 100 mounted thereon moves from the cup outlet position 2 to a third position γ. A second raw condensation in a raw condensation tank 46*b* cooled and stored in the refrigerator 45 is sent through a tubing pump 47*b* and discharged from a raw condensation discharge nozzle 48*b* generally vertically downward to be poured into the cup 100 mounted on the cup holder 3 at the third position γ. The cold drinking water passing through the cold water coil 13 is discharged from a cold drinking water discharge nozzle 49*b* generally vertically downward to be poured into the cup 100 mounted on the cup holder 3 at the third position γ.

When the user selects a third beverage, the cup 100 is supplied from the cup dispenser 1 to the cup holder 3 at the cup outlet position 2, as illustrated in FIG. 1. The cup holder 3 with the cup 100 mounted thereon moves from the cup outlet position 2 to a fourth position δ. A third raw condensation in a raw condensation tank 46*c* cooled and stored in the refrigerator 45 is sent through a tubing pump 47*c* and discharged from a raw condensation discharge nozzle 48*c* generally vertically downward to be poured into the cup 100 mounted on the cup holder 3 at the fourth position δ. The cold drinking water passing through the cold water coil 13 is discharged from a cold drinking water discharge nozzle 49*c* generally vertically downward to be poured into the cup 100 mounted on the cup holder 3 at the fourth position δ.

When the user selects a fourth beverage, the cup 100 is supplied from the cup dispenser 1 to the cup holder 3 at the cup outlet position 2, as illustrated in FIG. 1. The cup holder 3 with the cup 100 mounted thereon moves from the cup outlet position 2 to a fifth position ε. A fourth raw condensation in a raw condensation tank 46d cooled and stored in the refrigerator 45 is sent through a tubing pump 47*d* and discharged from a raw condensation discharge nozzle 48*d* generally vertically downward to be poured into the cup 100 mounted on the cup holder 3 at the fifth position ε. The cold drinking water passing through the cold water coil 13 is discharged from a cold drinking water discharge nozzle 49*d* generally vertically downward to be poured into the cup 100 mounted on the cup holder 3 at the fifth position ε.

In the above-mentioned manner, the supply of each of the first, the second, the third, and the fourth beverages into the cup 100 mounted on the cup holder 3 at the second, the third, the fourth, and the fifth positions β, γ, δ, and ε, respectively, is completed. Then, the cup holder 3 is moved to the cup outlet position 2. The user takes out the cup 100 filled with one of the first through the fourth beverages.

In the foregoing description, each of the refrigerators 28 and 45 is cooled by a refrigerant supplied from a cooling unit 50. The ice maker 4 is supplied from the sterilization tank 9 with the sterilized tap water as the drinking water and produces the ice cubes by the use of the drinking water. When the water in the sterilization tank 9 or the cooling water tank 14 is discharged, the water is received in a waste water tank 51.

Figure 2:
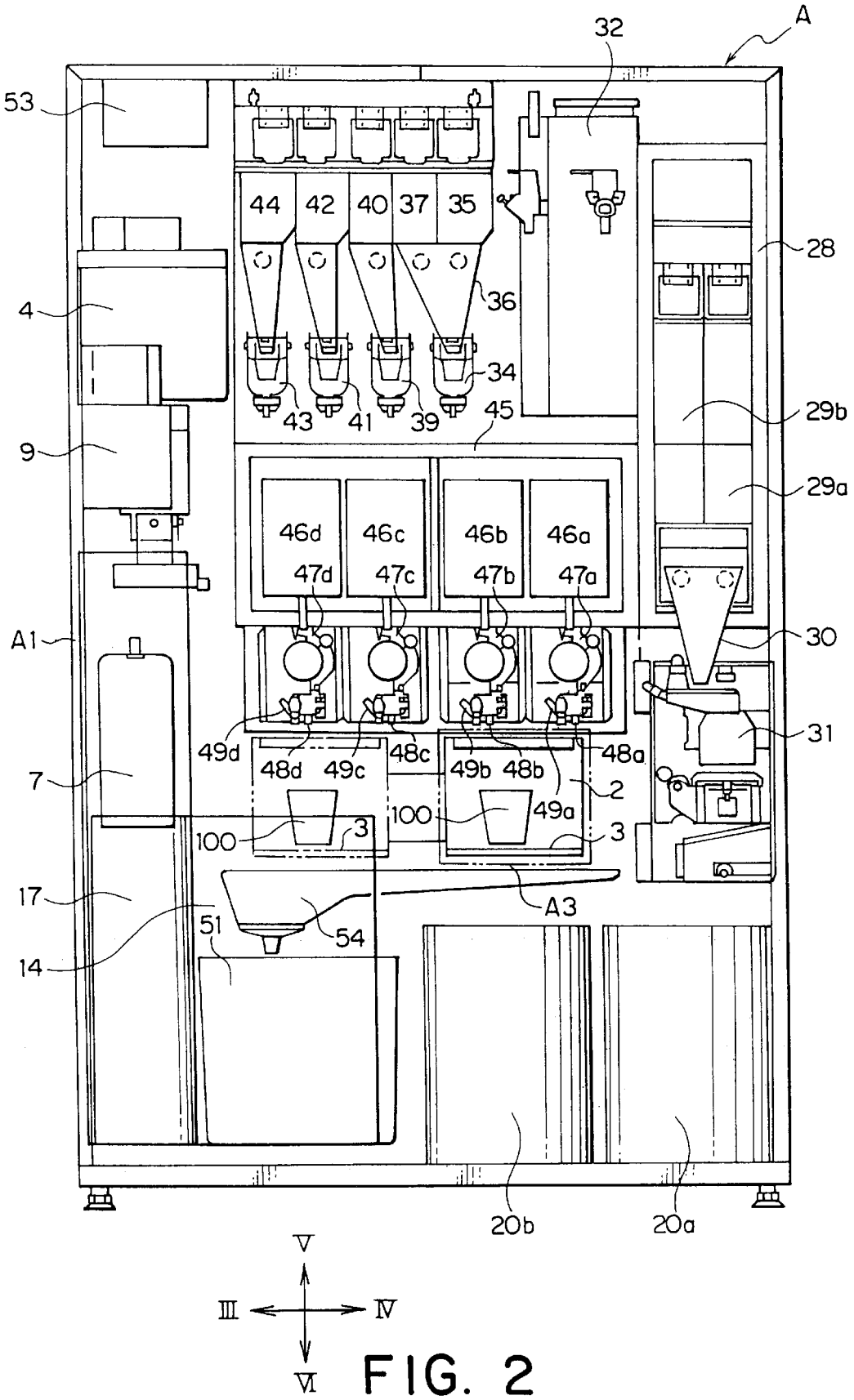
FIG. 2 is a front view of the automatic vending machine illustrated in FIG. 1 from which a front door and a cup dispenser are removed.
Figure 3:
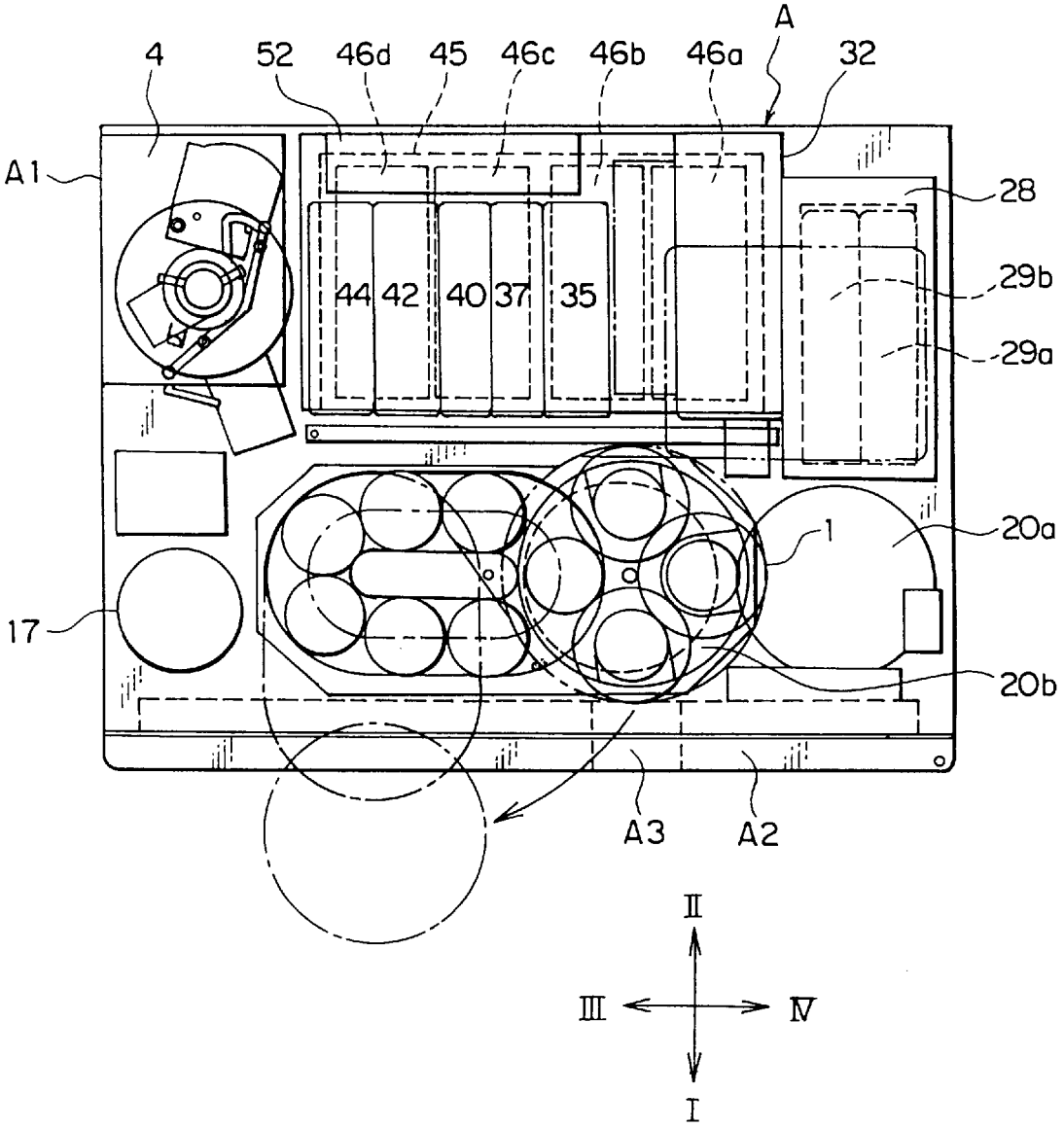
FIG. 3 is a top view of the automatic vending machine illustrated in FIG. 2 from which a ceiling wall is removed.

As illustrated in FIGS. 2 and 3, the automatic vending machine A comprises a box-shaped casing A1 having a front opening, and a swing door A2 closing the front opening of the casing A1. The beverage outlet port A3 is formed at an approximate center of the door A2 in the first horizontal direction (leftward/rightward direction) and slightly below a vertical center. Immediately behind the beverage outlet port A3, the cup outlet position 2 is defined. The door A2 has a coin slot (not shown) and a beverage selection button (not shown) formed on its front surface. Behind the door A2, the cup dispenser 1 is arranged. The cup dispenser 1 is arranged at an approximate center in the first horizontal direction (leftward/rightward direction) within a front space of the casing A1 and occupies about a half of a width of the front space in the first horizontal direction and about upper ⅔ of the height of the front space. In order to replenish the stock of cups in the cup dispenser 1, the door A2 is opened and the cup dispenser 1 is swung from an operating position depicted by a solid line in FIG. 3 to a maintenance position depicted by a dash-and-dot line in FIG. 3. The cup dispenser 1 contains a stack of a plurality of cups vertically stacked one on another and delivered downwards one by one, as disclosed in Japanese Unexamined Patent Publication (JP-A) No. 58-142496 (142496/1983).

The gas cylinder 17 is disposed at a lower left side of the cup dispenser 1. Behind the cup dispenser 1, the refrigerator 28 and the coffee beans powder storage tanks 29*a* and 29*b* are arranged in a rear space of the casing A1 at an upper right side. Immediately below the coffee beans powder storage tanks 29*a* and 29*b*, the chute 30 is disposed. Immediately below the chute 30, the coffee extraction unit 31 is arranged.

The hot water tank 32 is located at an upper part of the rear space of the casing A1 to be adjacent to the left of the refrigerator 28. At the upper part of the rear space of the casing A1, the sugar storage tank 35, the cream storage tank 37, the instant coffee powder storage tank 40, the instant cocoa powder storage tank 42, and the instant tea powder storage tank 44 are arranged adjacent to the left of the hot water tank 32. Below the sugar storage tank 35 and the cream storage tank 37, the mixing unit 34 is arranged. Below the instant coffee powder storage tank 40, the mixing unit 39 is arranged. Below the instant cocoa powder storage tank 42, the mixing unit 41 is arranged. Below the instant tea powder storage tank 44, the mixing unit 43 is arranged.

At a vertical center in the rear space of the casing A1, the refrigerator 45 is disposed below the hot water tank 32 and the mixing units 34, 39, 41, and 43. Within the refrigerator 45, the raw condensation tanks 46*a*, 46*b*, 46*c*, and 46*d* are stored. Discharge pipes fixed to bottom walls of the raw condensation tanks 46*a*, 46*b*, 46*c*, and 46*d* penetrate a bottom wall of the refrigerator 45 and extend downwards to be connected to the tubing pumps 47*a*, 47*b*, 47*c*, and 47*d* disposed directly under the refrigerator 45, respectively. Directly below the tubing pumps 47*a*, 47*b*, 47*c*, and 47*d*, the raw condensation discharge nozzles 48*a*, 48*b*, 48*c*, and 48*d* and the cold drinking water discharge nozzles 49*a*, 49*b*, 49*c*, and 49*d* are arranged. Behind the sugar storage tank 35, the cream storage tank 37, the instant coffee powder storage tank 40, the instant cocoa powder storage tank 42, and the instant tea powder storage tank 44, a control unit 52 of the automatic vending machine A is located.

A power supply box 53 is disposed at an upper left side of the rear space of the casing A1. The power supply box 53 is fixed to a ceiling wall of the casing A1. The ice maker 4 is disposed below the power supply box 53. Below the ice maker 4, the sterilization tank 9 is disposed. Below the sterilization tank 9, the filter 7 is located. Below the filter 7, the cooling water tank 14 is disposed.

Below the cup dispenser 1, the cup holder 3 is arranged to be movable in the upward, the downward, the leftward, the rightward, the forward, and the backward directions. As described above, the cup outlet position 2 of the cup holder 3 is defined immediately behind the beverage outlet port A3 formed in the door A2.

Below the cup holder 3, a drain catcher 54 is located. Below the drain catcher 54, the waste water tank 51 is arranged.

Figure 4:
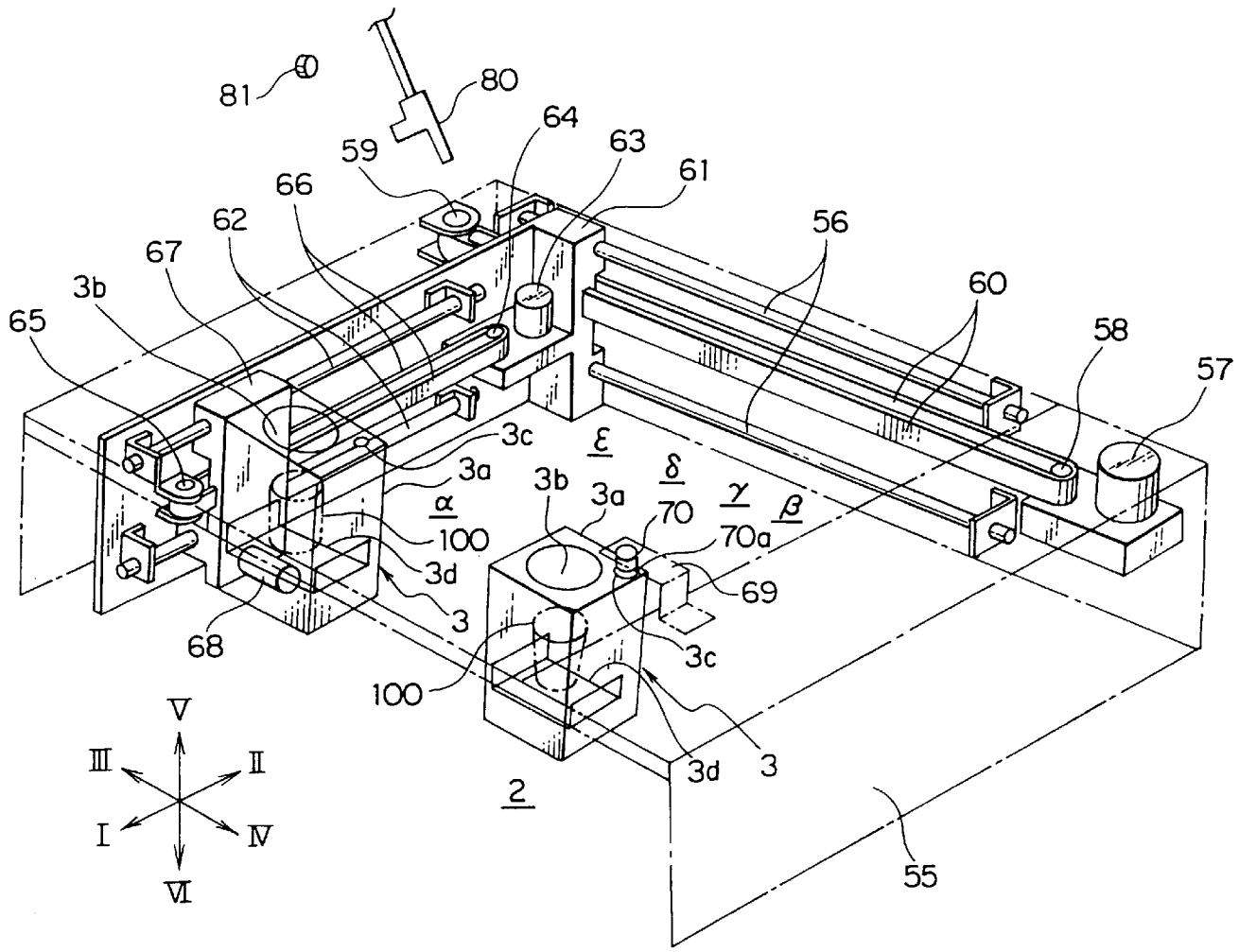
FIG. 4 is a perspective view of a cup holder and a cup holder driving device of the automatic vending machine illustrated in FIG. 2.
Figure 5:
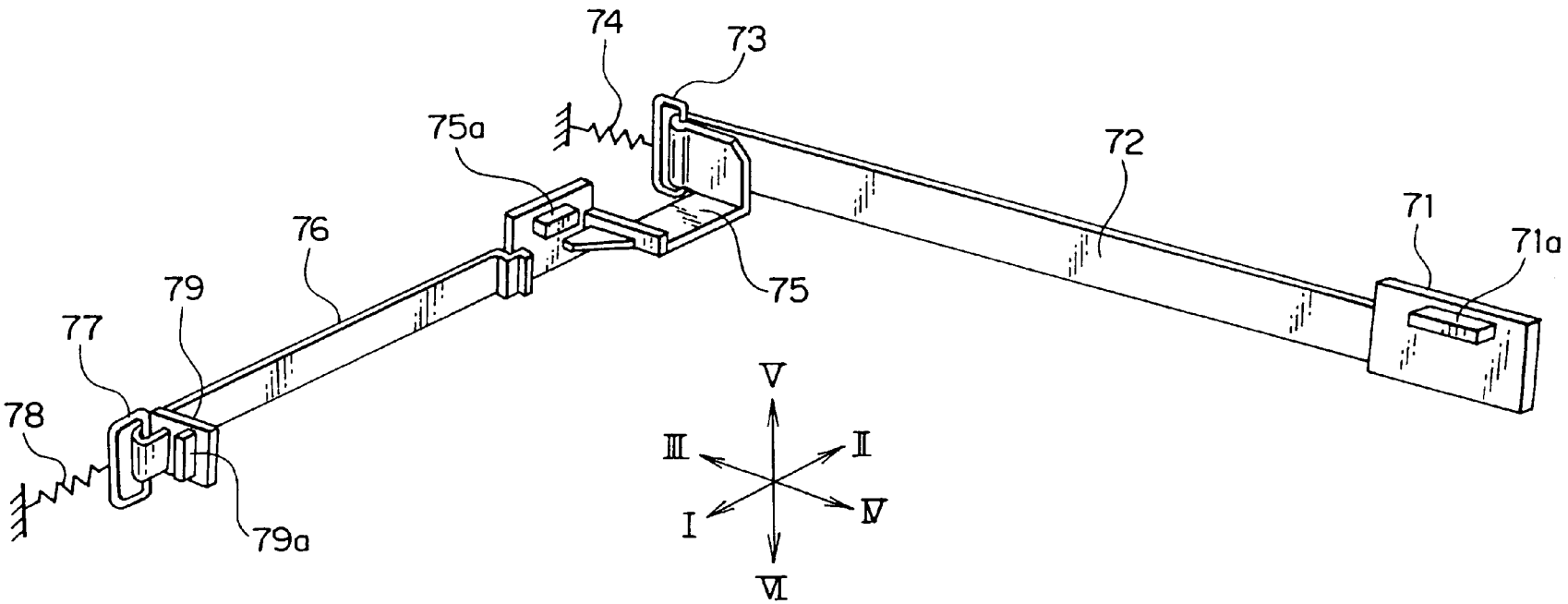
FIG. 5 is a perspective view of a flat cable of the cup holder driving device illustrated in FIG. 4.

Referring to FIGS. 4 and 5, description will be made about the cup holder 3 and a driving unit for driving the cup holder 3.

As illustrated in FIG. 4, a rectangular frame member 55 depicted by a dash-and-dot line in the figure is arranged in the casing A1 of the automatic vending machine A behind the beverage outlet port A3. The frame member 55 has left and right side walls and a rear wall. The left and the right side walls have front upper ends coupled by a narrow plate member. The frame member 55 has a ceiling wall which covers an upper right side of a rectangular space defined by the frame member 55.

A pair of guide members 56 are attached to the rear wall of the frame member 55 to extend in the first horizontal direction (leftward/rightward direction). To a right end portion of the rear wall of the frame member 55, a motor 57 and a drive pulley 58 rotated by the motor 57 are attached. To a left end portion of the rear wall of the frame member 55, a follower pulley 59 is attached. An endless belt 60 extending in the first horizontal direction (leftward/rightward direction) runs between the drive pulley 58 and the follower pulley 59. A carriage 61 extending in the second horizontal direction (forward/backward direction) has a rear end supported by the guide members 56 to be movable in the leftward and the rightward directions. The carriage 61 is fixed to a front runner of the endless belt 60.

To the carriage 61, a pair of guide members 62 extending in the second horizontal direction (forward/backward direction) are attached. A motor 63 and a drive pulley 64 rotated by the motor 63 are attached to the rear end of the carriage 61. The carriage 61 has a front end to which a follower pulley 65 is attached. An endless belt 66 extending in the second horizontal direction (forward/backward direction) runs between the drive pulley 64 and the follower pulley 65. A carriage 67 is supported by the guide members 62 to be movable in the forward and the backward directions. The carriage 67 is fixed to a right runner of the endless belt 66. A motor (not shown) is attached to a lower end of a left side surface of the carriage 67. The motor has an output shaft extending through the carriage 67 in the rightward direction. To the output shaft, a cam 68 extending in the rightward direction is attached.

A rectangular frame member 3*a* is attached to a right side surface of the carriage 67. The frame member 3*a* has left and right side walls, a rear wall, a ceiling wall, and a bottom wall. The frame member 3*a* is provided with a cup insertion hole 3*b* formed at the center of the ceiling wall. The frame member 3*a* has a locking hole 3*c* formed at a corner of the ceiling wall. A tray 3*d* is arranged in the frame member 3*a* and supported by the frame member 3*a* to be movable in the upward and the downward directions. The tray 3*d* has a bottom surface kept in contact with a cam 68. A combination of the frame member 3*a* and the tray 3*d* forms the cup holder 3.

To the ceiling wall covering the upper right side of the frame member 55, a bracket 69 is attached at a location near a front side. A solenoid 70 is attached to the bracket 69. The solenoid 70 has a piston 70*a* with its piston head arranged downside.

As illustrated in FIG. 5, a power supply terminal 71 is attached to the right end portion of the rear wall of the frame member 55. The power supply terminal 71 has a socket 70*a* through which the motor 57 is electrically fed. A flat cable 72 as a power supply cord extends from the power supply terminal 71 in the leftward direction. A shaft member 73 is engaged with the flat cable 72 in the vicinity of a left end of the flat cable 72. The shaft member 73 is attached to the left side wall of the frame member 55 through a spring 74 extendable in the first horizontal direction (leftward/rightward direction). The flat cable 72 has a folded portion folded to the right in the vicinity of its left end, i.e., at the engaging portion with the shaft member 73. A power supply terminal 75 is connected to the folded part of the flat cable 72 folded to the right as mentioned above. The power supply terminal 75 is fixed to the carriage 61. The motor 63 is electrically fed through a socket 75*a* of the power supply terminal 75. A flat cable 76 as a power supply cord extends in the forward direction from the power supply terminal 75. A shaft member 77 is engaged with the flat cable 76 in the vicinity of a front end of the flat cable 76. The shaft member 77 is attached to the front end of the carriage 61 through a spring 78 extendable in the second horizontal direction (forward/backward direction). The flat cable 76 has a folded part folded to the back in the vicinity of its front end, i.e., at the engaging portion with the shaft member 77. A power supply terminal 79 is connected to the folded part of the flat cable 76 folded to the back as mentioned above. The power supply terminal 79 is fixed to the carriage 67. The motor (not shown) attached to the carriage 67 is electrically fed through a socket 79*a* of the power supply terminal 79.

A first position sensor (not shown) for detecting a first horizontal position of the carriage 61 in the first horizontal direction (leftward/rightward direction) is attached to the frame member 55. A second position sensor (not shown) for detecting a second horizontal position of the carriage 67 in the second horizontal direction (forward/backward direction) is attached to the carriage 61. A third position sensor (not shown) for detecting a rotated position of the cam 68 is attached to the carriage 67. A door-open sensor (not shown) for detecting the opening of the door A2 of the automatic vending machine A is attached to the casing A1. At a rear left corner of the frame member 55, a washing nozzle 80 is disposed above the frame member 55. The washing nozzle 80 is supplied with the hot water from the hot water tank 32. In the vicinity of the washing nozzle 80, a washing switch 81 is disposed.

Description will be made about an operation of the driving unit for driving the cup holder 3.

When the motor 57 is activated and the endless belt 60 is driven, the carriage 61 fixed to the front runner of the endless belt 60 is guided by the guide members 56 to move in the leftward or the rightward direction. When the motor 63 is activated and the endless belt 66 is driven, the carriage 67 fixed to the right runner of the endless belt 66 moves in the forward or the backward direction. When the motor (not shown) attached to the carriage 67 is activated and the cam 68 is rotated, the tray 3*d* of the cup holder 3 with its bottom surface kept in contact with the cam 68 is moved in the upward or the downward direction.

When the carriage 61 is moved in the rightward direction, the flat cable 72 follows the rightward movement of the carriage 61 with its folded part increased in length. When the carriage 61 is moved in the leftward direction, the flat cable 72 follows the leftward movement of the carriage 61 with its folded part decreased in length. The folded part of the flat cable 72 is urged in the leftward direction through the shaft member 73 and the spring 74. Therefore, even if the carriage 61 is moved in the leftward or the rightward direction, the flat cable 72 is not loosened and the movement of the carriage 61 is not prevented. Because of its flexible nature, the flat cable 72 is free from damage due to fatigue even if it is folded at the engaging portion with the shaft member 73 along a small radius of curvature.

When the carriage 67 is moved in the backward direction, the flat cable 76 follows the backward movement of the carriage 67 with its folded part increased in length. When the carriage 67 is moved in the forward direction, the flat cable 76 follows the forward movement of the carriage 67 with its folded part decreased in length. The folded part of the flat cable 76 is urged in the forward direction through the shaft member 77 and the spring 78. Therefore, even if the carriage 67 is moved in the forward or the backward direction, the flat cable 76 is not loosened and the movement of the carriage 67 is not prevented. Because of its flexible nature, the flat cable 76 is free from damage due to fatigue even if it is folded at the engaging portion with the shaft member 77 along a small radius of curvature.

When the automatic vending machine A is in a standby state and the door A2 is closed, the control unit 52 recognizes the above-mentioned situation in response to signals from the door-open sensor and a coin sensor (not shown) for detecting the insertion of coins. Under control of the control unit 52, the carriages 61 and 67 are moved to a right end position and a front end position, respectively. As a result, the cup holder 3 is located at the cup outlet position 2 immediately behind the beverage outlet port A3 formed in the door A2 of the automatic vending machine A. Positioning of the carriages 61 and 67 is controlled in response to signals from the first position sensor for detecting the first horizontal position of the carriage 61 in the first horizontal direction (leftward/rightward direction) and from the second position sensor for detecting the second horizontal position of the carriage 67 in the second horizontal direction (forward/backward direction). Under control of the control unit 52, the piston 70*a* of the solenoid 70 is protruded downwards to be engaged with the engaging hole 3*c* of the cup holder 3. As a result, the cup holder 3 is prevented from the horizontal movement from the cup outlet position 2.

Even if a user's hand is inserted through the beverage outlet port A3 of the automatic vending machine A, the hand is blocked by the cup holder 3 and can not reach an inner area of the automatic vending machine A. It is therefore possible to prevent the user's hand from being inserted through the beverage outlet port A3 into the inner area of the automatic vending machine A to steal the stock of articles and to damage internal devices of the automatic vending machine A.

When the user inserts the coins through the coin slots and pushes the beverage selection button to select the desired beverage, the automatic vending machine A is put into operation, i.e., starts the vending operation. In response to the signals from the door-open sensor and the coin sensor, the control unit 52 recognizes the above-mentioned situation. Under control of the control unit 52, the piston 70*a* of the solenoid 70 is retracted upward to be released from the engagement with the locking hole 3*c* of the cup holder 3. As a result, the cup holder 3 is allowed to perform the horizontal movement from the cup outlet position 2. Under control of the control unit 52, the cup 100 is supplied from the cup dispenser 1 to the cup holder 3. The cup 100 passes through the cup insertion hole 3*b* of the frame member 3*a* and is supplied to the cup holder 3 to be mounted on the tray 3*d*. Depending upon the size of the cup 100 thus supplied, the cam 68 is rotated to adjust the height of the tray 3*d*. The carriage 61 moves in the leftward or the rightward direction while the carriage 67 moves in the forwards or the backward direction. As a consequence, the cup holder 3 moves in the forward or the rearward direction and in the leftward or the rightward direction. Depending upon the desired beverage selected by the user, the cup holder 3 moves to a corresponding one of the first, the second, the third, the fourth, and the fifth positions α, β, γ, δ, and ε. The desired beverage selected by the user is supplied to the cup 100 at the corresponding position. Again, the carriage 61 moves in the leftward or the rightward direction while the carriage 67 moves in the forward or the backward direction to return the cup holder 3 to the cup outlet position 2. The user then takes out through the beverage outlet port A3 the cup 100 filled with the desired beverage. It will be understood from the foregoing that, once the coins are inserted and the desired beverage is selected to put the automatic vending machine A into operation, the piston 70*a* of the solenoid 70 is retracted upward under control of the control unit 52 to allow the cup holder 3 to move from the cup outlet position 2 even if the door A2 of the automatic vending machine A is closed. Therefore, the movement of the cup holder 3 from the cup outlet position 2 to each of the first, the second, the third, the fourth, and the fifth positions α, β, γ, δ, and ε and vice versa can be performed without any trouble.

When the door A2 of the automatic vending machine A is opened by an operator during the standby state for the purpose of supply of the articles or maintenance and check, the control unit 52 is responsive to the signals from the door-open sensor and the coin sensor and recognizes the above-mentioned situation. Under control of the control unit 52, the piston 70*a* of the solenoid 70 is retracted upward to allow the cup holder 3 to move from the cup outlet position 2. As a result, the operator can manually move the cup holder 3 in the horizontal direction to perform storage of the articles and maintenance and check of the internal devices without any difficulty.

During the vending operation, the cup holder 3 is subjected to splash of the beverage discharged from each of the beverage discharge nozzles 23*a*, 23*b*, 38*a* through 38*d*, and 48*a* through 48*d* and after-dripping from each of the beverage discharge nozzles. As a result, the beverage is unfavorably adhered to the cup holder 3. In order to remove the beverage adhered to the cup holder 3, the cup holder 3 is washed during maintenance work of the automatic vending machine A. When the operator turns on the washing switch 81, the carriage 61 is moved in the leftward direction and the carriage 67 is moved in the backward direction under control of the control unit 52. As a result, the cup holder 3 is moved to a predetermined washing position at a rear left corner within a traveling area thereof. The washing position is determined by the washing nozzle 80. A combination of the washing nozzle 80 and the washing switch 81 will be refered to as a washing arrangement.

The operator makes the washing nozzle 80 discharge the hot water as washing water to wash the cup holder 3 to remove the beverage adhered thereto. After washing, the washing water passes through the drain catcher 54 located below the cup holder 3 to flow into the waste water tank 51 located below the drain catcher 54. A combination of the waste water tank 51 and the drain catcher 54 will be referred to as a draining arrangement. The cup holder 3 is located at the predetermined washing position at the rear left corner within the travelling area and is apart from the front opening of the casing A1 of the automatic vending machine A. Therefore, the washing water is prevented from splashing out of the casing A1 when the cup holder 3 is washed. Thus, it is possible to prevent the washing water from soiling the floor surface where the automatic vending machine A is installed.

What is claimed is:

1. An automatic vending machine for vending a beverage poured into a cup, said automatic vending machine comprising:

control means for controlling operation of said automatic vending machine;

a cup holder for holding said cup;

a washing position determined for a wash of said cup holder; and a driving unit connected to said cup holder and said control means for moving said cup holder under control of said control means, said driving unit making said cup holder be placed at said washing position before said cup holder is washed.

2. An automatic vending machine as claimed in claim 1, further comprising a cup dispenser connected to said control means for dispensing said cup to said cup holder under control of said control means.

3. An automatic vending machine as claimed in claim 1, further comprising beverage supplying means connected to said control means for supplying said beverage into said cup, held to said cup holder, under control of said control means.

4. An automatic vending machine as claimed in claim 1, further comprising a cup outlet position determined for an outlet of said cup from said vending machine, said cup outlet position being displaced from said washing position.

5. An automatic vending machine as claimed in claim 1, further comprising washing means connected to said control means for washing said cup holder at said washing position.

6. An automatic vending machine as claimed in claim 5, wherein said washing means comprises:

a washing switch; and a washing nozzle responsive to operation of said washing switch for discharging washing water towards said cup holder placed at said washing position.

7. An automatic vending machine as claimed in claim 6, further comprising draining means for draining said washing water as waste water from said washing position after washing.

8. An automatic vending machine as claimed in claim 7, wherein said draining means comprises:

a drain catcher for catching said waste water at said washing position; and a waste water tank connected to said drain catcher for receiving said waste water therein.

* * * * *